US006532763B1

(12) United States Patent
Gupte

(10) Patent No.: US 6,532,763 B1
(45) Date of Patent: Mar. 18, 2003

(54) EVAPORATOR WITH MIST ELIMINATOR

(75) Inventor: Neelkanth S. Gupte, Liverpool, NY (US)

(73) Assignee: Carrier Corporation, Farmington, CT (US)

( * ) Notice: Subject to any disclaimer, the term of this patent is extended or adjusted under 35 U.S.C. 154(b) by 0 days.

(21) Appl. No.: 10/139,572

(22) Filed: May 6, 2002

(51) Int. Cl.[7] ..... F25B 39/02
(52) U.S. Cl. ..... 62/515; 55/434.4; 55/465
(58) Field of Search ..... 62/515; 165/159, 165/160; 55/434, 434.2, 434.3, 434.4, 462, 465

(56) References Cited

U.S. PATENT DOCUMENTS 4,642,149 A * 2/1987 Harper ..... 165/159
4,669,279 A * 6/1987 Maeda et al. ..... 62/505
4,671,082 A * 6/1987 Maeda et al. ..... 62/515
4,829,786 A * 5/1989 Sand et al. ..... 184/109
4,972,903 A * 11/1990 Kwok ..... 165/158
5,044,427 A * 9/1991 Love et al. ..... 165/159
5,561,987 A * 10/1996 Hartfield et al. ..... 165/117
5,836,382 A * 11/1998 Dingle et al. ..... 165/160
5,839,294 A * 11/1998 Chiang et al. ..... 165/117
6,293,112 B1 * 9/2001 Moeykens et al. ..... 165/115

* cited by examiner

*Primary Examiner*—William E. Tapolcai
*Assistant Examiner*—Mohammad M. Ali
(74) *Attorney, Agent, or Firm*—Wall Marjama & Bilinski LLP

(57) ABSTRACT

In a refrigeration system having a cooler with liquid refrigerant therein, a heat exchanger is provided above the heat transfer tubes so as to interrupt any liquid refrigerant droplets that tend to be entrained in the refrigerant vapor as it is boiled off from the heat transfer tubes and caused to pass upwardly to the compressor suction inlet. The liquid droplets that collect on the heat exchanger are boiled off with the resultant refrigerant vapor passing on to the compressor suction inlet. The heat exchanger medium passing through the heat exchanger can be the cooling fluid that subsequently passes through the heat transfer tubes, or it may be condensate that is received from the condenser.

19 Claims, 2 Drawing Sheets

EVAPORATOR WITH MIST ELIMINATOR

BACKGROUND OF THE INVENTION

This invention relates generally to air conditioning systems and, more particularly, to a method and apparatus for reducing liquid carry over from an evaporator.

In a refrigeration circuit, wherein refrigerant vapor passes from the evaporator to the compressor, to the extent that the refrigerant isn't completely evaporated, liquid refrigerant may be passed on to the compressor as liquid carry over, which affects both the performance and the life of the compressor.

There are generally two types of evaporator applications in which liquid carry over is a particular problem: flooded evaporators and falling film evaporators. In a flooded evaporator, wherein liquid refrigerant is introduced in the lower part of the evaporator shell, liquid droplets tend to be entrained in the refrigerant vapor flow leaving at the top of the heat exchanger tube bank. Similarly, in a falling film evaporator arrangement, wherein two phase refrigerant is introduced at the top of the tube bank, there tends to be a significant amount of liquid refrigerant that is entrained into the compressor suction.

One approach to solving this problem is to provide a liquid/vapor separator, either internally or externally of the evaporator. While these are effective, they add substantial expense to the system.

Another approach has been to provide sufficient vertical space between the top of the tube bank and the suction nozzle at the top of the shell such that droplets will be caused to flow downwardly by the force of gravity before they reach the suction nozzle. This, of course, requires the use of a larger shell, which in turn is costly because of the added materials and space that it occupies.

Yet another approach has been to provide a so called "eliminator" in the form of a wire mesh, between the top of the tube bank and the compressor suction. Such an eliminator tends to interrupt the flow of the liquid droplets, allowing them to collect on the eliminator and to eventually fall by the force of gravity. This approach is somewhat effective in controlling liquid carry over and, while it requires less space then the approach described hereinabove, it does require some additional space for the eliminator and also involves the cost of the eliminator. Further it is recognized as being passive in the sense that it simply turns back the droplets which, again, will tend to be entrained in the flow of refrigerant vapor as before.

In addition to the commonly used flooded evaporator and falling film evaporator applications discussed hereinabove, the present invention may be applicable to increase the system efficiency such that other applications become feasible. For example, in air conditioning systems in which the refrigerant is driven by reciprocating or scroll compressors, direct expansion evaporators, rather then flooded evaporators, are used because flooded evaporators do not provide sufficient suction super heat for use with such compressors. However, the use of flooded evaporators would be preferred if this problem can be overcome.

It is therefore an object of the present invention to provide an improved evaporator arrangement for reducing liquid carry over.

Another object of the present invention is the provision in an evaporator for effectively using the space within the evaporator shell.

Yet another object of the present invention is the provision for using a flooded evaporator in a system with reciprocating or scroll compressors.

Still another object of the present invention is the provision for an evaporator that is efficient and effective in use.

These objects and other features and advantages become more readily apparent in reference to the following description when taken in conjunction with the appended drawings.

SUMMARY OF THE INVENTION

Briefly, in accordance with one aspect to the invention, a baffle is located above the tube banks for interrupting the upward flow of liquid refrigerant droplets that would otherwise tend to flow to the compressor along with the refrigerant vapor. Heat is added to the baffle to cause an evaporation of the liquid droplets such that the resulting vapor passes to the compressor.

In accordance with another aspect of the invention, the baffle structure comprises a heat exchange having a fluid flowing therethrough, with a temperature of the fluid being warmer that the refrigerant such that sufficient heat is transferred to the refrigerant droplets to bring about the desired vaporization.

By yet another aspect of the invention, the fluid passing through the baffle heat exchanger can be warm water diverted from the entering the first pass of the cooler or it may be liquid refrigerant leaving the condenser before entering the expansion device.

In the drawings it is hereinafter described, a preferred embodiment is depicted; however, various other modifications and alternate constructions can be made thereto without departing from the true spirit and scope of the invention.

DETAILED DESCRIPTION OF THE INVENTION

Figure 1:
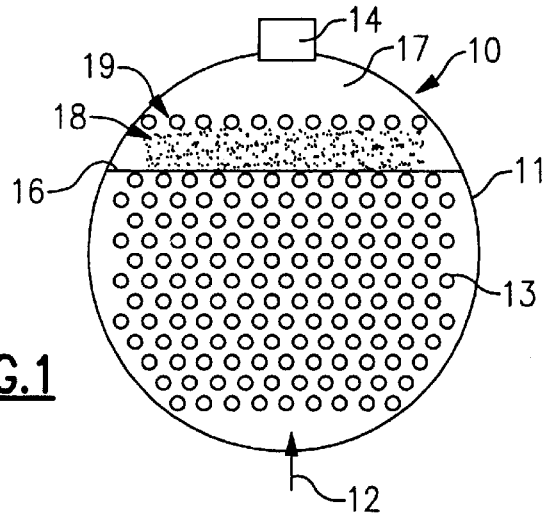
FIG. 1 is a schematic illustration of a flooded evaporator with the present invention incorporated therein.

Referring know to FIG. 1, the invention is shown generally at 10 as incorporated into a flooded evaporator 11 having a liquid refrigerant inlet 12 at its lower end, a plurality of serially connected tubes 13 and a compressor suction inlet 14 at it upper end.

The refrigerant tubes 13 carry a liquid to be cooled, with the liquid entering at the lower passes and working its way serially upwardly to the upper passes as it is cooled by the liquid refrigerant in which the tubes are immersed. As will be seen, the level of liquid refrigerant remains just above the upper tube row as shown at 16, and above that, there is an open space 17 in which the evaporated refrigerant vapor can pass to the compressor suction 14. However, just above the liquid refrigerant level 16 there are liquid refrigerant droplets 17 that tend to be entrained in the rising refrigerant vapor and if not interrupted will be allowed to flow into the compressor suction 14. To prevent this from occurring, an active eliminator 19 is provided in the open space 17. The purpose of the active eliminator 19 is to interrupt the upward flow of the liquid refrigerant droplets 18 and to heat those droplets to vaporization such that the vapor can then pass to the compressor suction 14. In this way, the carry over of liquid droplets to the compressor suction 14 is prevented.

Figure 2:
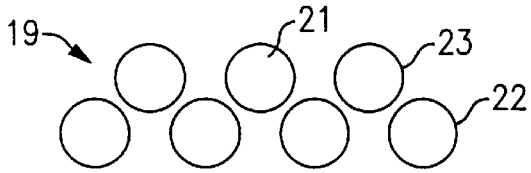
FIG. 2 is a schematic illustration of the active eliminator portion of the present invention.

Referring now to FIG. 2, there is shown one embodiment of an active eliminator as comprising a plurality of heat exchanger tubes 21 arranged in staggered relationship in first 22 and second 23 rows. The tubes 21 are coupled to carry a medium flow which is at a temperature sufficiently high so as to boil off the liquid refrigerant droplets that attach to the eliminator 19. The active eliminator 19 may take any number of forms. For example, the staggered tube bank as shown may be comprised of low cost finned tubes in either a single or multiple rows. It could also take the form of a plate fin coil or a parallel flow heat exchanger core such is used in automotive air conditioning systems.

Figure 3:
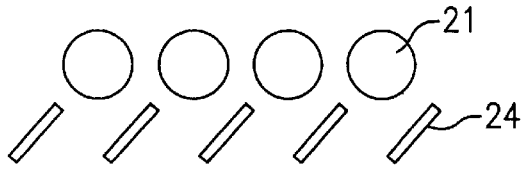
FIG. 3 is an alternative embodiment thereof.

An alternative active eliminator is shown in FIG. 3 as comprising a single row of heat exchanger tubes 21 with a plurality of deflector louvers 24 therebelow for the purpose of directing entrained liquid onto the active eliminator tubes 21. This louvered arrangement prevents the upward flow of liquid droplets from passing between the heat exchanger tubes 21 of a single row heat exchanger.

Figure 4:
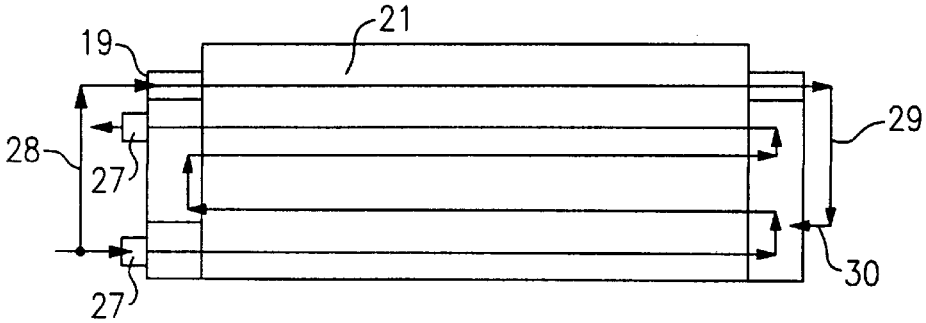
FIG. 4 is a schematic illustration of the heat exchanger and coolant flow in accordance with the present invention.

The medium that passes through the active eliminator 19 may originate from various sources. For example, it may be relatively warmer water diverted from that entering the first pass of the chiller as shown in FIG. 4 wherein a first pass is shown at 26 and a last pass is shown at 27, with several passes therebetween not being called out by number. As will be seen at line 28 carries water from the first pass 26 directly to the active eliminator 19 where it passes through tubes 21 and then is returned by line 29 to an intermediate pass 30 of the tube bank.

Another alternative for the medium within the active eliminator 19 is the condensate from the condenser 20 (see dotted line) which again, is at a higher temperature than the refrigerant in the evaporator and will be sufficiently hot as to enable the boiling off of the liquid refrigerant droplets. After passing through the tubes 21 the cooler liquid passes to the expansion device 25 as shown by the dotted line.

Figure 5:
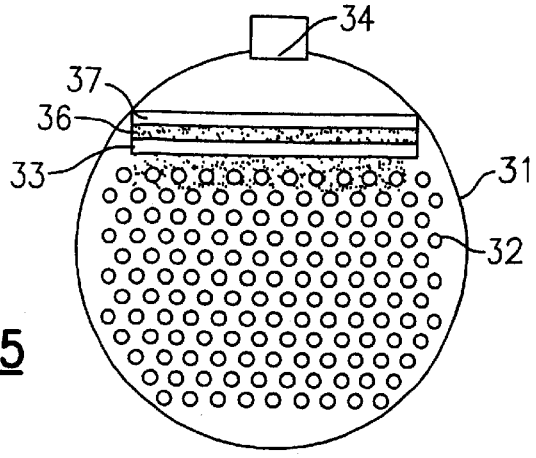
FIG. 5 is a schematic illustration of a falling film evaporator with the present invention incorporated therein.

Having described the invention as used with a flooded evaporator, the invention will now be described with reference to a falling film evaporator as shown at 31 in FIG. 5. Here, a plurality of water carrying tubes 32 are arranged in staggered relationship in a plurality of rows in an identical manner as for the flooded evaporator as described hereinabove. However, rather then being immersed in liquid refrigerant, they are brought into contact with the refrigerant by way of a distributor 33 that is mounted above the tube rows for the purpose of distributing two phase refrigerant over the tube bank in a conventional manner. As the refrigerant falls over the tubes, the water therein causes the refrigerant to evaporate and cool the water in the process. The refrigerant vapor then rises to the compressor suction 34 in the same manner as for the flooded evaporator described hereinabove. In the process there is a certain amount of liquid droplets 36 that are entrained in the raising vapor and which will enter the compressor suction 34 unless other provisions are made. For that purpose an active eliminator 37 is mounted above the distributor 33 such that it will interrupt the upward flow of the liquid droplets entrained in the vapor. The structure, purpose, and manner of performance of the active eliminator 37 is substantially identical to that of the active eliminator 19 as described hereinabove.

Figure 6:
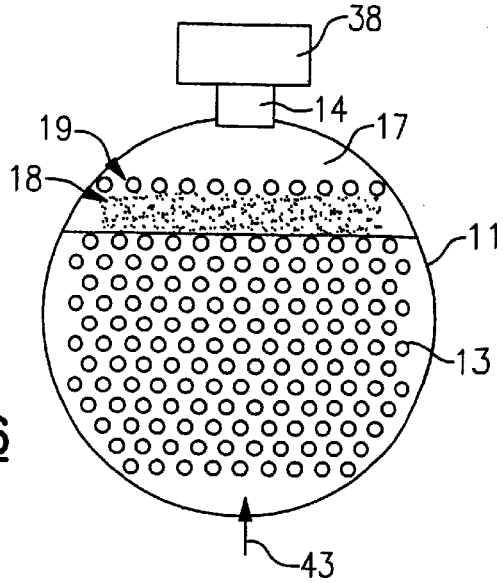
FIG. 6 is a schematic illustration of a flooded evaporator with an alternative type of compressor and with the present invention incorporated therein.
Figure 7:
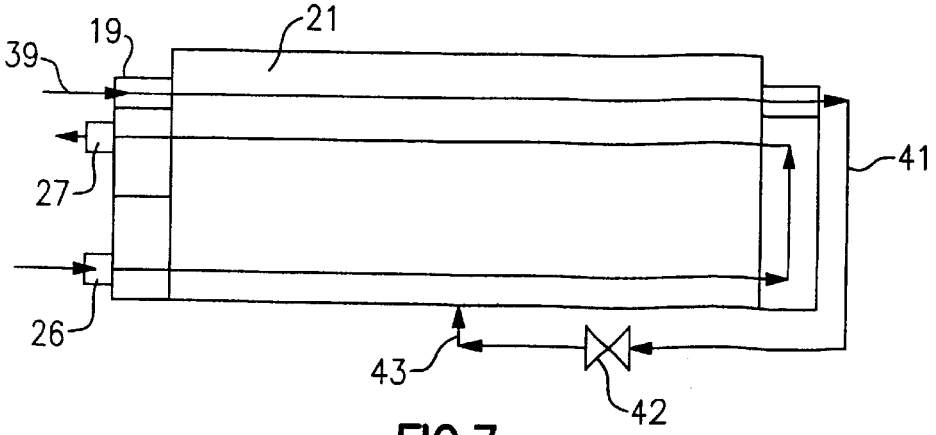
FIG. 7 is an alternative heat exchanger coolant flow arrangement in accordance with the present invention.

Whereas the invention has been described in terms of use with a flooded evaporator and a falling film evaporator wherein the compressor is generally of the centrifugal type, the present invention may also be used in smaller flooded evaporator applications wherein the compressor 38 receiving the refrigerant vapor is of the reciprocating or scroll type as shown in FIG. 6. Here the conventional DX evaporator that is normally used with such a compressor is replaced with a flooded evaporator chiller substantially identical to that as described in FIG. 1 except of a smaller size. This combination is made possible because of the increase in superheat that is accomplished by the use of the active eliminator 19 in converting the liquid droplets to more useful superheated vapor. The result is a possible 2 to 2.5 times the overall heat transfer coefficient as compared with a direct expansion (DX) evaporator and a 4 to 5% improvement in COP, which is due to the fact that the compressor lift is reduced for air cooled application. And this also offers the potential to reduce the cost and footprint of condenser coils. The active eliminator 19 is again a heat exchanger with a high temperature medium flowing therein. As shown in FIG. 7, the medium is preferably hot condensate 39 flowing into the active eliminator 19, passing through the tubes 21 and then along line 41 to an expansion valve 42 for entry into the refrigerant inlet 43. In this way, the active eliminator acts like a "suction heat exchanger" and ensures suction superheat that would not be present in a comparable DX unit. Of course, as an alternative the hot water from the first pass can be used for purposes of providing heat to the active eliminator 19 as shown and described in FIG. 4 above.

We claim:

1. In an air conditioning system of the type having an evaporator for receiving refrigerant in a liquid state, exposing the refrigerant to a heat exchanger surface and causing a portion of refrigerant to be heated and converted to vaporous state for the flow thereof to a compressor, an improved evaporator structure comprising:

an evaporator shell for receiving refrigerant therein, said refrigerant being at least partially in a liquid state;

a plurality of heat transfer tubes being disposed in said shell for internally conducting the flow of a cooling fluid therethrough to be cooled by said refrigerant disposed externally thereof with at least a portion of said refrigerant being converted to vapor in the process;

a suction port located in an upper portion of said shell for conducting the flow of said refrigerant vapor to the compressor;

and a baffle disposed between said heat transfer tubes and said suction port for interrupting the flow of liquid refrigerant droplets as they move upwardly with the flow of refrigerant vapor, said baffle having a heat exchange surface which is maintained in a heated condition so as to cause at least some of said droplets to evaporate.

2. An evaporator structure as set forth in claim 1 wherein said baffle comprises a heat exchanger having an internal flow passage therein.

3. An evaporator structure as set forth in claim 2 wherein said heat exchanger is connected such that the internal fluid therein is cooling fluid which passes from said heat exchanger to said heat transfer tubes.

4. An evaporator structure as set forth in claim 2 wherein said heat exchanger is connected to conduct the flow of condensate from the condenser.

5. An evaporator structure as set forth in claim 1 wherein said evaporator is of the flooded type, with liquid refrigerant being introduced in its lower portion so as to submerge at least a portion of said heat transfer tubes.

6. An evaporator structure as set forth in claim 1 wherein said evaporator is of the falling film type and includes a refrigerant distribution system located above said heat transfer tubes.

7. An evaporator structure as set forth in claim 6 wherein said baffle is disposed above said refrigerant distribution system.

8. A method of reducing liquid carry over in a refrigeration system having an evaporator which receives liquid refrigerant that is vaporized in a cooling process, with the refrigerant vapor tending to carry liquid refrigerant droplets with it as it flows to a compressor suction inlet, comprising the steps of:

providing a plurality of heat transfer tubes within an evaporator shell, said tubes being adapted to internally conduct the flow of a liquid to be cooled;

exposing an outer side of at least some of said heat transfer tubes to liquid refrigerant to be heated and converted to refrigerant vapor;

providing a baffle structure between said heat transfer tubes and the compressor suction inlet to interrupt the flow of liquid refrigerant droplets that are entrained in said refrigerant vapor; and heating said baffle to a degree necessary to boil at least some of said droplets and allowing the resultant vapor to pass to the compressor suction inlet.

9. A method as set forth in claim 8 wherein said baffle is a heat exchanger.

10. A method as set forth in claim 9 wherein said step of heating said baffle is accomplished by conducting the flow of liquid to be cooled through said heat exchanger prior to its passing to said heat transfer tubes.

11. A method as set forth in claim 9 wherein said heating step is accomplished by circulating condensate from the condenser through said heat exchanger.

12. A method as set forth in claim 8 wherein said evaporator is of the flooded type and wherein said step of exposing said heat transfer tubes to liquid refrigerant is accomplished by introducing refrigerant at a lower portion of said evaporator shell and submerging at least a portion of said heat transfer tubes.

13. A method as set forth in claim 8 wherein said evaporator is of the falling film type and wherein said step of exposing said heat transfer tubes to liquid refrigerant is accomplished by way of a refrigerant distribution system located above said plurality of heat transfer tubes.

14. A cooler for a chiller apparatus of the type having a compressor disposed above the cooler and being fluidly interconnected thereto by a suction inlet comprising:

a plurality of heat exchanger tubes disposed in a shell of said cooler, said tubes being connected to a fluid source for circulating a fluid to be cooled;

refrigerant supply means for introducing liquid refrigerant to be placed in contact with said tubes for evaporating the liquid refrigerant such that the resultant vapor can be drawn upwardly into the suction inlet; and a heat exchanger located between said tubes and the suction inlet such that any liquid refrigerant droplets that may be entrained in the raising vapor will be interrupted by, and caused to collect on, said heat exchanger, said heat exchanger having a medium flowing therein at a temperature that is sufficiently high as to cause the evaporation of at least some of the droplets.

15. A cooler as set forth in claim 14 wherein the medium flowing through said heat exchanger comprises the fluid which subsequently passes through said heat exchanger tubes.

16. A cooler as set forth in claim 14 wherein said medium flowing through said heat exchanger comprises condensate from a condenser.

17. A cooler as set forth in claim 14 wherein said chiller is of the flooded type and further wherein said refrigerant supply means provides liquid refrigerant at a lower portion of said shell.

18. A cooler as set forth in claim 14 wherein said chiller is of the falling film type and includes a refrigerant distribution system disposed above said heat exchanger tubes.

19. A cooler as set forth in claim 18 wherein said heat exchanger is located above said refrigerant distribution system.

* * * * *